US005445546A

United States Patent [19]

Nakamura

[11] Patent Number: 5,445,546

[45] Date of Patent: Aug. 29, 1995

[54] SHIFT ASSISTOR FOR OUTBOARD DRIVE SHIFTING MECHANISM

[75] Inventor: Daisuke Nakamura, Hamamatsu, Japan

[73] Assignee: Sanshin Kogyo Kabushiki Kaisha, Japan

[21] Appl. No.: 185,542

[22] Filed: Jan. 24, 1994

[30] Foreign Application Priority Data

Jan. 22, 1993 [JP] Japan ..... 5-027385

[51] Int. Cl.[6] ..... B63H 23/08

[52] U.S. Cl. ..... 440/75; 74/378; 74/470; 192/21; 440/86

[58] Field of Search ..... 440/75, 86; 192/21, 192/51; 74/378, 470

[56] References Cited

U.S. PATENT DOCUMENTS 4,668,198 5/1987 Nakamura ..... 440/86

FOREIGN PATENT DOCUMENTS 0128257 6/1989 Japan .

*Primary Examiner*—Sherman Basinger

*Attorney, Agent, or Firm*—Knobbe, Martens, Olson & Bear

[57] ABSTRACT

A shift assistor for a shifting mechanism of a watercraft outboard drive provides a simply structured and compact device which establishes engagement of the transmission under a resilient force and disengagement under a positive force. The shift assistor includes a shift plunger which is coupled to a shift operator and an actuator casing which is coupled to the transmission. A detent coupling is directly operable between the plunger and the casing to couple the plunger to the casing when the transmission is engaged either in the forward or reverse drive directions, and to release the plunger from the casing when the transmission is disengaged.

24 Claims, 4 Drawing Sheets

SHIFT ASSISTOR FOR OUTBOARD DRIVE SHIFTING MECHANISM

BACKGROUND OF THE INVENTION

1. Field of the Invention

The present invention relates in general to a marine propulsion system, and more particularly to a shifting system for an outboard drive transmission.

2. Description of Related Art

Many forms of outboard drives employ forward, neutral, reverse transmissions. Such transmissions are common in both outboard motors and in the outboard drive units of inboard-outboard motors. These transmissions typically include a dog clutches to couple rotating members together. A shifting mechanism normally controls the actuation of the clutch in either the forward or reverse drive directions.

It is generally desirable to engage the clutch with a transmission gear under a resilient force to allow the teeth of the clutch and the corresponding transmission gear to register before engagement. It also is generally desirable to disengage the clutch from the transmission gear under a positive force for immediate responsive.

Prior shift assistor devices have been used to resiliently engage and positively disengage the clutch from the transmission. These prior devices, however, involve many components and tend to be overly complicated. For instance, in one such prior device, two distinct couplings mechanisms are used independently to couple a shift rod and an actuator rod together, depending upon the drive direction. One detent coupling couples the shift operator and clutch actuator together in one drive direction and the other detent coupling couples the shift operator and clutch actuator together in the other drive direction. These distinct mechanisms are further linked together which produces a very complex and complicated mechanism.

SUMMARY OF THE INVENTION

A need therefore exists for a shifting mechanism which selectively couples a shift operator and a transmission actuator together in either drive direction through a simply structured and compact shift assistor mechanism.

A first feature of the present invention is adapted to be embodied in a shifting mechanism of a watercraft outboard drive which selectively establishes at least a first, second and third drive conditions of a transmission. The shifting mechanism includes a shift assistor which has a biasing member interposed between a first member and a second member. The first member is coupled to the transmission and is movable from a first position, in which the transmission is in the first drive condition, to either a second position, in which the transmission is in the second drive condition, or a third position in which the transmission is in the third drive condition. The second member also is movable from a first position to either a second position or a third position. The shift assistor also includes a detent coupling which is directly operable between the first member and the second member to releasably couple the first and second members together. A detent mechanism may also be used with the shifting mechanism which is releasably coupled to the first member to releasably retain the first member in one of its positions. The second member is movable from the first position to either the second or third positions to load the biasing member and to urge the first member to release from the detent mechanism. The biasing member then urges the first member from its first position to either its second or third positions. The detent coupling interconnects the first and second members when the first member is positioned in either its second or third positions.

In a preferred embodiment, the detent coupling couples the first and second members together as they move from either the second or third positions to the first position, and decouples the first and second members in the first position so that the first and second members are movable relative to each other from the first position to either the second or third positions.

Another feature of the present invention is also adapted to be embodied in a shifting mechanism for an outboard device of a watercraft. The shifting mechanism selectively establishes either a first drive condition or a second drive condition of a transmission. The shifting mechanism comprises a shift operator and a transmission actuator interconnected by a shift assistor which releasably couples the transmission actuator to the shift operator with the transmission actuator in a first position, in which the transmission is in the first drive condition, and in a second position, in which the transmission is in the second drive condition. The shift assistor comprises a first member and a second member that are juxtaposed together. The first and second members are supported for relative movement. The first member is connected to the shift operator and the second member is connected to the transmission actuator. The shift assistor also includes detent means which is directly operable between the first and second members to releasably couple the first and second members together when in the first position or in the second position.

In accordance with a preferred embodiment, the first and second members are movable from the first and second positions to a third position in which the transmission is in a third drive condition. The detent means couples the first and second members together from the first position to the third position and from the second position to the third position. The detent mechanism also decouples the first and second members when in the third position to allow the first and second members to move relative to each other from the third position to either the first or second positions.

BRIEF DESCRIPTION OF THE DRAWINGS

These and other features of the invention will now be described with reference to the drawings of preferred embodiments which are intended to illustrate and not to limit the invention, and in which.

DETAILED DESCRIPTION OF PREFERRED EMBODIMENTS

Figure 1:
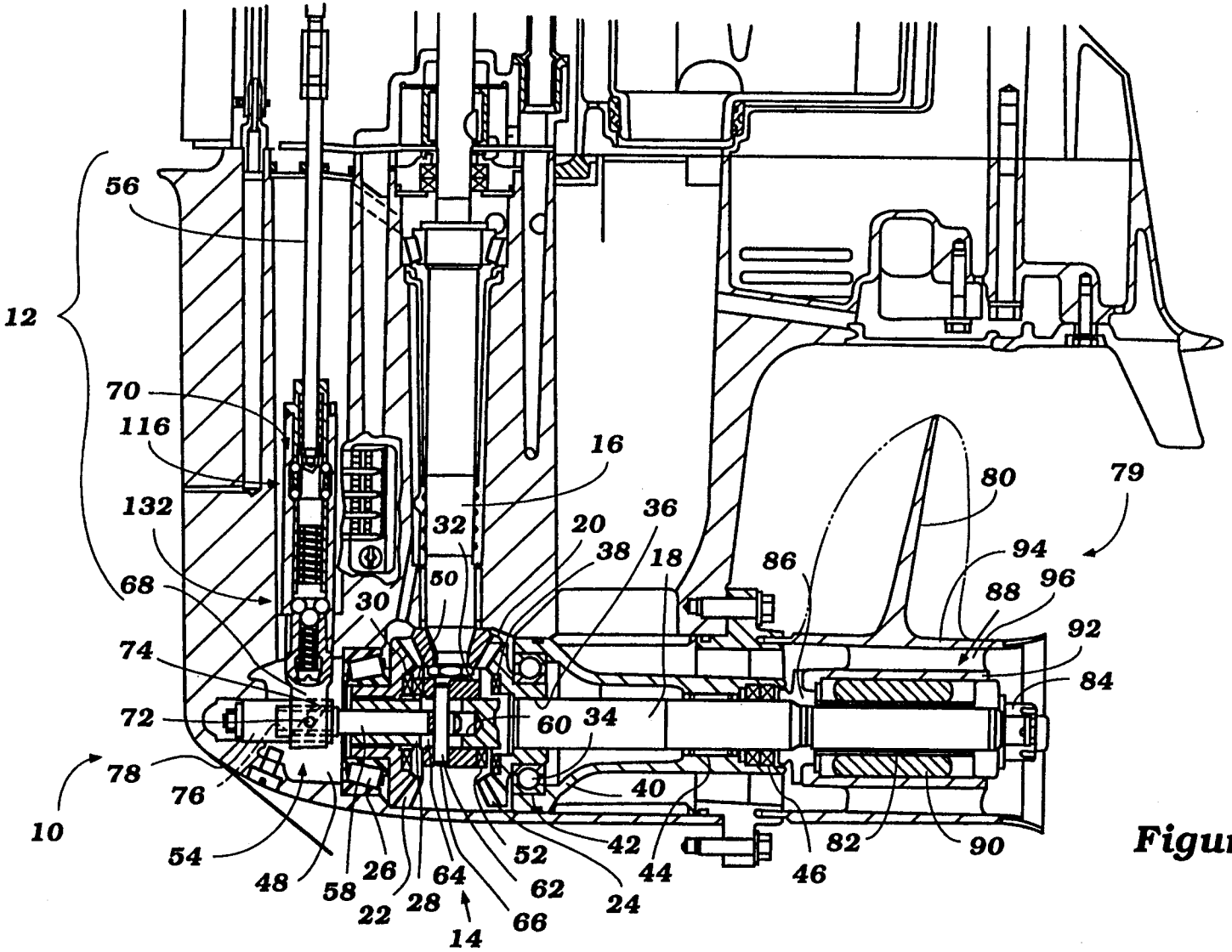
FIG. 1 is a sectional, elevational view of a marine outboard drive employing a shift assistor in accordance with a preferred embodiment of the present invention.

FIG. 1 illustrates a lower unit 10 of a marine outboard drive which incorporates a sifting mechanism 12, the basic understanding of which is essential to an appreciation of the present invention. Though the present invention has equal applicability to a variety of different types of transmissions, including spur gear transmissions, multiple-disk transmissions, or the like, FIG. 1 illustrates an exemplary lower unit 10 which includes a dog clutch transmission 14. It should also be appreciated that the lower unit 10 may form the lower unit of an outboard motor or, alternatively, the lower unit of an outboard drive of an inboard/outboard motor.

With reference to FIG. 1, a drive shaft 16 extends through the lower unit 10 and is suitably journaled therein by known means. A motor (not shown) drives the drive shaft 16.

The transmission 14 selectively couples the drive shaft 16 to a propulsion shaft 18 to drive the propulsion shaft 18, as discussed in detail below. The transmission 14 advantageously is a forward, neutral, reverse-type transmission; however, it is understood that the transmission 14 could be a multiple speed transmission as well.

The drive shaft 16 carries a drive gear 20 at its lower end, which is disposed within the lower unit 10 and which forms a portion of the transmission 14. The drive gear 20 preferably is a bevel gear.

The transmission 14 also includes a pair of counter-rotating driven gears 22, 24 that are in mesh engagement with the drive gear 20. The pair of driven gears 22, 24 are positioned on diametrically opposite sides of the drive gear 20, and are suitably journaled within the lower unit 10, as described below. Each driven gear 22, 24 is positioned at about a 90° shaft angle with the drive gear. That is, the propulsion shaft 18 and the drive shaft 16 desirably intersect at about a 90° shaft angle; however, it is contemplated that the drive shaft 16 and the propulsion shaft 18 can intersect at almost any angle.

In the illustrated embodiment, the pair of driven gears are a front bevel gear 22 and an opposing rear bevel gear 24. The front gear 22 includes a hub which is journaled within the lower unit by a front thrust bearing 26. The front thrust bearing 26 rotatably supports the front gear 22 in mesh engagement with the drive gear 20.

The front gear 22 has a central bore through which the propulsion shaft 18 passes when assembled. A bushing 28 journals the propulsion shaft 18 within the bore of the front gear hub 22. The front gear 22 also includes a series of teeth formed on an annular, rear facing engagement surface which positively engage a portion of a clutch 32 of the transmission 14, as discussed below.

The rear gear 24 also includes a hub which is suitably journaled within the housing of the lower unit 10 by a rear bearing 34. The rear bearing 34 rotatably supports the rear gear 24 in mesh engagement with the drive gear 20.

The rear gear hub 24 has a central bore through which the propulsion shaft 18 passes when assembled. A bushing 36 journals the propulsion shaft 18 within the bore of the rear gear hub 24. The rear gear 24 also includes an annular front engagement surface which carries a series of teeth 38 for positive engagement with the clutch 32 of the transmission 14, as known in the art.

The propulsion shaft 18 extends through the first and second driven gears 22, 24 and through a bearing casing 40. A front end ring 42, attached to the lower unit 10, secures the bearing casing 40 to the lower unit 10.

The bearing casing 40 rotatably supports the propulsion shaft 18. For this purpose, a needle bearing 44 supports the propulsion shaft 18 with the bearing casing 40 at an opposite end of the bearing casing from the rear bearing 34, which is also supported by the bearing casing 40.

A pair of seals 46 (e.g., oil seals) is interposed between the bearing casing 40 and the propulsion shaft 18 at the rear end of the bearing casing 40. Lubricant within a lubricant sump 48 flows through the gaps between the bearing casing 40 and the shaft 18 to lubricate the bearings 34, 44 which support the propulsion shaft 18. The seals 46 which are located at the rear end of the bearing casing 40 substantially prevent lubricant flow beyond this point.

With continual reference to FIG. 1, the transmission 14 also includes the clutch 32 that selectively couples the propulsion shaft 18 to one of the driven gears 22, 24. Though various known clutch mechanisms may be used in connection with the present invention, FIG. 1 illustrates a conventional dog clutch mechanism. As discussed in detail below, the dog clutch 32 selectively couples the propulsion shaft 18 to either the front driven gear 22 or the rear driven gear 24.

The dog clutch 32 has a spool-like shape and includes an axial bore which extends between an annular front end plate and an annular rear end plate. The bore is sized to receive the propulsion shaft 18.

The annular end plates of the front clutch 32 are substantially coextensive in size with the annular engagement surfaces of the front and rear gears 22, 24. Teeth 50, 52 extend from each end plate and correspond to the respective teeth 30, 38 of the front and rear gears 22, 24, as known in the art.

The clutch 32 has a spline connection to the propulsion shaft 18 which establishes a drive connection between the clutch 32 and the shaft 18, yet permits the clutch 32 to slide along the axis of the shaft 18 between the front and rear gears 22, 24. The clutch 32 specifically includes internal splines within the bore that mate with corresponding external splines on the outer periphery of the inner propulsion shaft 18.

The shifting mechanism 12 moves the clutch 32 between forward, neutral and reverse drive conditions. At its operator end, the shifting mechanism 12 includes a gear shifter (not shown) of a known type which is coupled to an actuator mechanism 54. The gear shifter is mounted conventionally, proximate to the steering controls (not shown) of the watercraft, and includes a conventional shift lever (not shown). The shift lever is conventionally coupled to a shift rod 56, which in turn is coupled to the actuator mechanism 54.

At its actuator end, the shifting mechanism 12 includes a plunger 58 which is slidably supported within a bore 60 form in the front end of the propulsion shaft 18. A pin 62 axially affixes the plunger 58 to the clutch 32. The pin 62 extends transversely through the rear end of the plunger 58, through a complementary aperture 64 formed in the propulsion shaft 18, and through a central bore of the clutch 32. The pin 62 may be held in place by a press-fit connection between the pin 62 and the hole of the plunger 58, and/or by a conventional coil spring 66 which is contained within a groove about the midsection of the clutch 32. The aperture 64 of the propulsion shaft 18 has a sufficient axial length to accommodate axial movement of the pin 62 during the shifting operation, as discussed below.

The plunger 58 has a generally cylindrical rod shape and may be solid or hollow. At its front end, the plunger 58 rotatably connects to actuator mechanism 54.

As noted above, the actuator mechanism 54 moves the plunger 58 from a position in which the clutch 32 engages either the front or rear driven gears 22, 24, through a position of nonengagement (i.e., the neutral position), and to a position in which the clutch engages the other driven gear 22, 24. The actuator mechanism 54 positively reciprocates the plunger 58 between these positions.

FIG. 1 illustrates an exemplary embodiment of the actuator mechanism 54 which may be used with the present invention. The actuator mechanism 54 connects the plunger 58 to the shift rod 56. The actuator mechanism 54 desirable converts vertical linear movement of the shift rod 56 into horizontal linear movement of the plunger 58 to move the plunger 58 generally along the axis of the propulsion shaft 18.

In this embodiment, the actuator mechanism 54 includes a drive member 68 which the shift rod 56 moves up or down through a shift assistor 70, as described below. The shift rod 56 extends vertically through the lower unit 10 to selectively operate the drive member 68.

The drive member 68 includes a pin 72 which rides in a diagonal slot 74 of a follower member 76 of the actuator mechanism 54. The pin 72 forces the follower member 76 to slide axially as the pin 72 of the drive member 68 moves up and down and rides within the slot 74. In the illustrated embodiment, upward movement of the pin 72 causes the follower member 76 to move forward, and downward movement of the pin 72 causes the follower member 76 to move rearward.

An actuator casing 78 slidably supports the follower member 76 at the forward end of the lower unit 10. The follower member 76 has a spline connection with the actuator casing 78 to prevent rotation of the follower member 76.

The follower member 76 rotatably connects to the plunger 58 to axially reciprocate the plunger 58. For this purpose, the follower member may include a conventional yoke connection formed on its rear end in which a head of the plunger 58 is received. The yoke includes a generally U-shaped aperture which opens into a recess from the rear end of the yoke. The recess desirably has a generally cylindrical shape. The width of the aperture is advantageously less than the diameter of the recess. When assembled, the recess receives the head of the plunger 58 with a reduced diameter neck of the plunger 58 inserted through the aperture of the yoke. In this manner, the follower member 76 and the plunger 58 are rotatably interconnected. This connection permits the follower member 76 to transmit linear movement to the plunger 58, while permitting the plunger 58 to rotate relative to the follower member 76.

The propulsion shaft 18 drives a propulsion device, such as, for example, a propeller device 79, a hydrodynamic jet, or the like. In the illustrated embodiment, the propulsion device is a single blade propeller 80. It is contemplated, however, that those skilled in the art will appreciate that the present invention can readily be adapted for use with a counter-rotating dual propeller device or other propulsion device.

In the illustrated embodiment, the propulsion shaft 18, on its end exposed beyond the casing 40, tapers in diameter towards its rear end. The tapered rear end of the shaft 18 carries an engagement sleeve 82 having a spline connection with the tapered rear end of the inner shaft 18. The sleeve 82 is fixed to the shaft rear end between a nut 84 threaded onto the rear end of the shaft 18 and an annular retainer ring 86 that engages the tapered section of the shaft 18 proximate to the shaft rear end.

The shaft 18 also carries a propeller boss 88. An elastic bushing 90 is interposed between the engagement sleeve 82 and the propeller boss 88 and is compressed therebetween. The bushing 90 is secured to the engagement sleeve 82 by a heat process known in the art. The frictional engagement between the boss 88, the elastic bushing 90, and the engagement sleeve 82 is desirably sufficient to transmit rotational forces from the sleeve 82 to the propeller 80 attached to the propeller boss 88.

The propeller boss 88 has an inner sleeve and an outer sleeve 92 to which the propeller blade 80 is integrally formed. A plurality of radial ribs 96 extend between the inner sleeve 92 and the outer sleeve 94 to support the outer sleeve 94 about the inner sleeve 96 and to form passages through the propeller boss 88. Engine exhaust is exhausted through these passages in the propeller boss 88, as known in the art.

The outboard drive transmission 14, shifting mechanism 12 and propulsion unit 79 as thus so far described are generally typical of the prior art construction. However, in accordance with the present invention, an improved shift assistor 70 is incorporated into the shifting mechanism to engage the clutch 32 of the transmission 14 under a resilient force as well as to disengage the clutch 32 of the transmission 14 under a positively force.

The following embodiments of the shift assistor illustrate several forms in which the present invention may be adapted for use with various shifting mechanisms 12. As such, these embodiments are for illustration purposes only and are not meant to limit the invention in any way.

Embodiment of FIGS. 1 and 2

FIG. 1 illustrates a shift assistor 70 in accordance with a preferred embodiment of the present invention. In general, the shift assistor 70 interconnects a shift operator, which is connected to the shift lever, and a transmission actuator, which is connected to the transmission. In the illustrated embodiment, the shift assistor 70 interconnects the shift rod 56 to the drive member 68 of the actuator mechanism 54.

FIG. 2 best illustrates the individual components of the shift assistor 70. In this embodiment, the shift assistor 70 includes a cylindrical plunger 100 attached to the upper end of the shift rod 56. The plunger 100 includes an annular neck portion 102 of a diameter less than the overall diameter of the plunger 100. The neck portion 102 forms an annular recess 104 that circumscribes the midsection of the plunger 100.

The shift assistor 70 also includes an intermediate tubular casing 106 which has an inner bore 108 through which the plunger 100 slides. In the illustrated embodiment, the intermediate casing 106 includes a closed upper end 110 which defines an aperture through which the shift rod 56 passes. At its lower end, the intermediate casing 106 connects to the drive member 68 of the actuator mechanism 54. Specifically, an upper end of the drive member 68 is piloted into a lower end of the intermediate casing and is attached thereto by known means, such as, for example, by a interference fit.

Figures 2A, 2B, 2C, 2D, 2E:
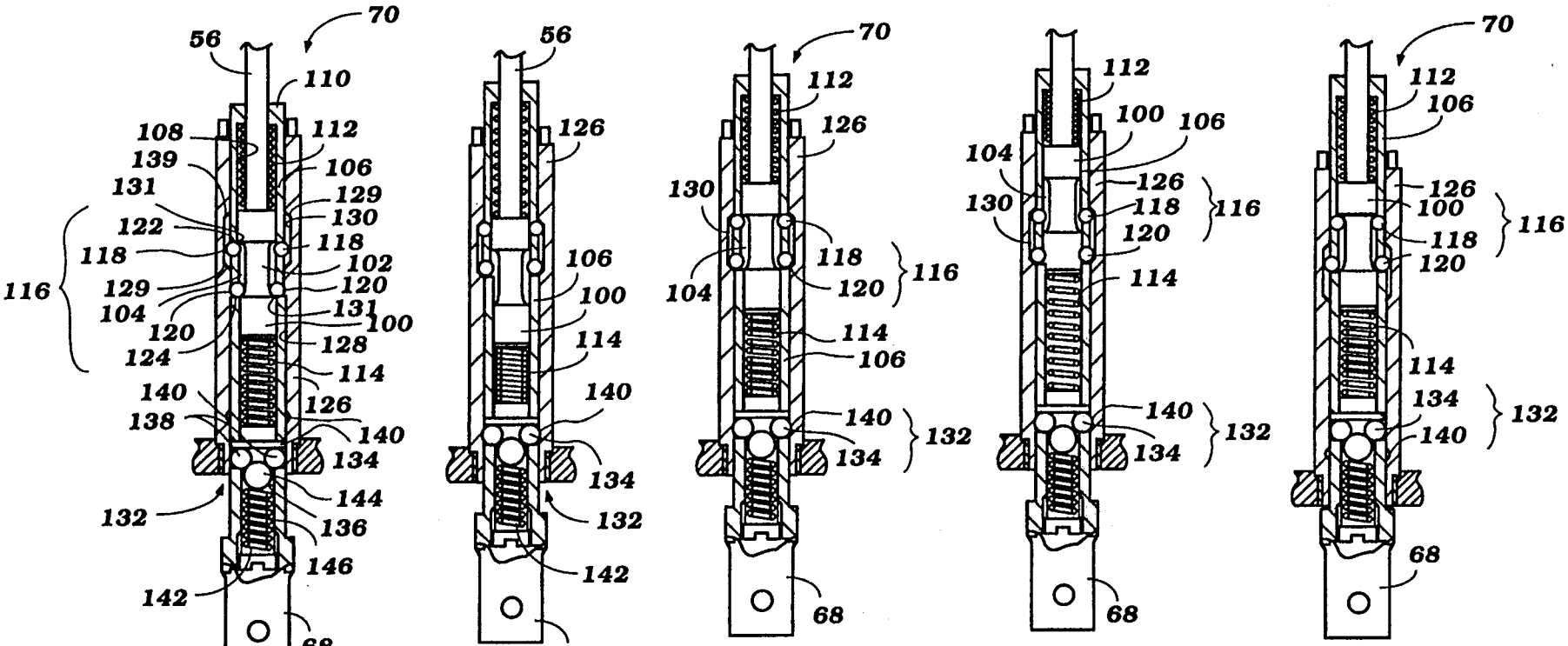
FIGS. 2*a* through 2*e* are a series of developed sectional, elevational views illustrating the actuation of the shift assistor of FIG. 1 under forward, neutral and reverse drive conditions.

As FIG. 2*a* illustrates, the plunger 100 is captured within the intermediate casing 106. The inner bore 108 of the casing 106 has a diameter slightly larger than that of the cylindrical plunger 100. The plunger 100 thus freely slides within the bore 108. The plunger 100, however, is interposed between a pair of biasing members 112, 114, such as springs, which support the plunger 100 within the bore 108.

The intermediate casing 106 carries a detent coupling 116 which selectively couples the plunger 100 and the intermediate casing 106 together, as described below. In this embodiment, the detent coupling 116 desirable includes at least a first detent 118 and a second detent 120 positioned within transverse holes, and more preferably include a first pair of diametrically opposed detents 118 positioned in a first transverse hole 122, and a second pair of diametrically opposed detents 120 positioned in a second transverse hole 124. The transverse holes are axially spaced apart along the length of the intermediate casing 106. The diameter of the detents 118, 120 is slightly smaller than the diameter of the corresponding hole 122, 124 so that the detents 118, 120 pass freely through the holes 122, 124.

An outer casing 126 of the shift assistor 70 supports the intermediate casing 106 and the detent coupling 116. The outer casing 126 slidably supports the intermediate casing 106 within an inner bore 128. The outer casing 126 also includes an annular recess 130 within its inner bore 128.

The outer casing recess 130 and the plunger recess 104 desirably have substantially equal axial lengths. Each recess 104, 130 desirably has an axial length greater than the distance by which the drive member 68 moves from its neutral position to a position in which the clutch 32 engages a driven gear 22, 24. The axial lengths of the recesses 104, 130 more preferably generally equal the distance between the upper detents 118 and the lower detents 120. Each recess 104, 130 also has a depth which is sized to receive the portion of the detents 118, 120 which extend beyond the wall of the intermediate casing 106 when the other recess 104, 130 is out of phase, i.e., when the recesses 104, 130 do not coincide, as illustrated in FIGS. 2*a* and 2*b*. The recesses 104, 130 also include camming surfaces 129, 131 at their axial ends.

The shift assistor 70 desirably includes a detent mechanism 132 which holds the actuator mechanism 54 (and the coupled clutch 32) in the neutral position. In the illustrated embodiment, the neutral detent mechanism 132 is positioned within the drive member 68 of the actuator mechanism 54.

With reference to FIG. 2, the neutral detent mechanism 132 is formed in part by at least one transversely positioned hole 134 which intersects a bore 136 of the drive member 68. The transverse hole 134 receives at least one and preferably two detent balls 138. The detent balls 138 have a diameter slightly smaller than diameter of the hole 134.

The outer casing 126 includes detent recesses 140 formed on the inner wall of the bore 128 through which the intermediate casing 106 slides. These recesses 140 are positioned so as to locate the clutch 32 in the neutral position when the detent hole 134 of the drive member 68 is aligned with the detent recesses 140 of the outer casing 126.

A ball plunger 142, formed by a larger ball 144 and a helical compression spring 146, biases the detent balls 134 radially outward, against the inner wall of the outer casing bore 128. The drive member 68 contains the ball 144 and the spring 146 within its bore 136 with the ball slidable therein. For this purpose, the ball 144 has a diameter slightly smaller that the diameter of the bore 136 of the drive member 68.

The large ball 144 slides upward and forces portions of the detent balls 134 into the corresponding detent recesses 140 when the drive member 68 is moved into the neutral position, as illustrated in FIG. 2*c*. The spring force acting on the large ball 144 urges the large ball 144 upward and thus biases the detent balls 134 into this position. This releasably connection between the detent balls 134 of the drive member 68 and the detent recesses 140 of the outer casing 126 releasably restrains movement of the drive member 68 relative to the outer casing 126.

The operation of this embodiment will now be described with reference to FIGS. 2*a* through 2*e*. FIGS. 2*a* through 2*e* illustrate the actuation of the shift assistor 70 under three drive conditions. In the illustrated embodiment, FIG. 2*a* illustrates the shift assistor 70 position to establish a forward drive condition of the transmission; FIG. 2*c* illustrates the shift assistor 70 position to establish a neutral drive condition; and FIG. 2*e* illustrates the shift assistor position to establish a reverse drive condition.

FIGS. 2*c*, 2*b* and 2*a* represent the sequence of shift assistor positions as the transmission 14 is moved from its neutral position to its forward drive position. With reference to FIG. 2*c*, the neutral detent mechanism maintains the transmission 14 in its neutral position. To establish a forward drive condition of the transmission 14, the gear shift lever (not shown) is moved from a neutral position to a forward position. The shift rod 56 moves in response. Specifically, in the illustrated embodiment, the shift rod 56 moves vertically downward which causes the plunger 100 to depress within the intermediate casing 106.

With reference to FIG. 2*b*, the plunger 100 compresses the lower biasing member 114 between the plunger's lower end and the upper end of the drive member 68, which is piloted in the lower end of the intermediate casing 106. The plunger 100 desirably fully compresses (i.e., loads) the biasing member 114. With the biasing member 114 fully loaded, as illustrated in FIG. 2*b*, further movement of the plunger 100 causes the drive member 68 to move downward relative to the outer casing 106. When the plunger 100 is moved with sufficient force to overcome the retaining force of the neutral detent mechanism 132, the detent balls 134 ride over the wall of the detent recesses 140 and are cammed inwardly against the action of the ball plunger 142.

The drive member 68 begins to move downward under to force of the loaded biasing member 114 once the neutral detent mechanism 132 has released. The drive member 68 and the attached intermediate member 106 move together from a neutral position to a forward drive position, which is illustrated by FIG. 2*a*. The downward movement of the drive member 68 causes the follower member 76 of the actuator mechanism 54 to move rearward which in turn moves the plunger 58 rearward. The clutch 32, carried by plunger 58, in turn moves rearward to engage the rear driven gear 24 of the transmission.

Importantly, the clutch 32 engages the driven gear 24 under a resilient force in order to reduce coupling shock and to allow the corresponding teeth 38, 52 of the clutch 32 and gear 24 to register. The loaded biasing member 114 of the shift assistor 70 provides the resilient force which urges the clutch 32 to engage the driven gear 24.

It should also be noted that the biasing members 112, 114 in the present embodiment absorb any positioning errors between the drive positions (forward, neutral, or reverse) of the shift rod 56 and the corresponding drive positions of the plunger 58 which is attached to the drive member 68 for direct actuation. That is, the biasing members 112, 114 either compress or expand to absorb any variances in position between the drive member 68 and the shift rod 56 when in corresponding drive positions.

The detent coupling mechanism 116 couples the intermediate casing 106 and the plunger 100 together in the forward drive position. With reference to FIG. *2c*, the plunger recess 104 and the corresponding recess 130 of the outer casing 106 initially coincide when the plunger 100 and intermediate casing 106 are in their neutral positions. The detents 118, 120 float freely between the recesses 104, 130.

As illustrated in FIG. *2b*, an upper section of the plunger 100 forces the upper detents 118 outwardly, into the recess 130 of the outer casing 106 as the plunger 100 slides within the intermediate casing 106 to compress the lower biasing member 114. The lower detents 120 still freely float between the corresponding recess 104, 130 when the plunger 106 has loaded the biasing member 114.

As the intermediate casing 106 moves from its neutral position to its forward drive position and relative to the plunger 100 and outer casing 126, the lower cam surface 129 of the outer casing recess 130 forces the lower detents 120 into the plunger recess 104. The intermediate casing 106 moves relative to the plunger 100 and outer casing 126 under the force of the biasing member 114 to a position where, as best seen in FIG. *2a*, the lower detents 120 are captured within the plunger recess 104 and against the lower camming surfaces 131 of the plunger recess 104. In this manner, the intermediate casing 106 and the plunger 100 are coupled so as to move together from the forward drive position to the neutral position.

FIGS. *2a* and *2c* represent the sequence of shift assistor positions as the transmission 14 is moved from its forward drive position to its neutral position. As described above, the detent coupling 116 couples the intermediate casing 106 and the plunger 100 together. To establish a neutral drive condition of the transmission 14, the gear shift lever (not shown) is moved from its forward position to its neutral position which causes the shift rod 56 and the plunger 100 to move upward. The intermediate casing 106 also moves upward with the plunger 100 because the detent coupling 116 couples the plunger 100 and casing 106 together until these components return to their neutral position, as described above and as illustrated in FIG. *2c*.

As a result of the direct coupling between the plunger 100 and the intermediate casing 106, the drive member 68 is positively pulled upward. The plunger 58 in turn moves forward to disengage the clutch 32 from the driven gear 24 under a positive force. That is, the plunger 100 positively pulls the clutch 32 out of engagement with the gear 24.

To establish a reverse drive direction for the transmission 14, the shift assistor 70 is actuated in a similar manner, but in the opposite direction. FIGS. *2c*, *2d* and *2e* illustrate the sequence of shift assistor positions during the shift assistor actuation in this direction.

As noted above, FIG. *2c* illustrates the shift assistor 70 in its neutral position. To establish a reverse drive condition of the transmission 14, the gear shift lever (not shown) is moved from its neutral position to a reverse position. This action causes the shift rod 56 and the attached plunger 100 to move upward within the intermediate casing 106.

With reference to FIG. *2d*, the plunger 100 compresses the upper biasing member 112 between the upper end of the plunger 100 and the upper end of the intermediate casing 106. The plunger 100 desirably fully compresses (i.e., loads) the biasing member 112. With the spring fully loaded, as illustrated in FIG. *2d*, further movement of the plunger 100 causes the intermediate casing 106 and the attached drive member 68 to move upward relative to the outer casing 126. When the plunger 100 is moved with sufficient force to overcome the retaining force of the neutral detent mechanism 132, the detent balls 134 release from the detent recesses 140, as described above.

The intermediate casing 106 and drive member 68 begin to move upward under to force of the loaded biasing member 112 once the neutral detent mechanism 132 has released. The upward movement of the drive member 68 causes the follower member 76 of the actuator mechanism 54 to move forward which in turn moves the plunger 58 forward. The clutch 32 carried by plunger 58 in turn moves forward to engage the front driven gear 22 of the transmission 14. It again should be noted that in this embodiment, the clutch 32 engages the driven gear 32 under the resilient force of the loaded biasing member 112.

The detent coupling mechanism 116 also couples the intermediate casing 106 and the plunger 100 together in the reverse drive position. With reference to FIG. *2d*, an lower section of the plunger 100 forces the lower detents 120 outwardly, into the recess 130 of the outer casing 106 as the plunger 100 slides within the intermediate casing 106 to compress the upper biasing member 112. The upper detents 118 still freely float between the corresponding recess 104, 130 when the plunger 100 has loaded the upper biasing member 112.

As the intermediate casing 106 moves from its neutral position to its reverse drive position and relative to the plunger 100 and outer casing 126, the upper cam surfaces 129 of the outer casing recess 130 forces the upper detents 118 into the plunger recess 104. The intermediate casing 106 moves relative to the plunger 100 and outer casing 126 under the force of the biasing member 112 to a position where, as best seen in FIG. *2e*, the upper detents 118 are captured within the plunger recess 104 and against the upper camming surfaces 131 of the plunger recess 104. In this manner, the intermediate casing 106 and the plunger 100 are coupled so as to move together.

FIGS. *2e* and *2c* represent the sequence of shift assistor positions as the transmission 14 is moved from its reverse drive position to its neutral position. As described above, the detent coupling 116 couples the intermediate casing 106 and the plunger 100 together. To establish a neutral drive condition of the transmission 14, the gear shift lever (not shown) is moved from its reverse position to its neutral position which causes the shift rod 56 and the plunger 100 to move downward. The intermediate casing 106 also moves downward with the plunger 100 because the detent coupling 116 couples the plunger 100 and casing 106 together until these components return to their neutral position. The plunger 100 thus positively forces the drive member 68 downward, which in turn disengages the clutch 32 under a positive force.

Figure 3:
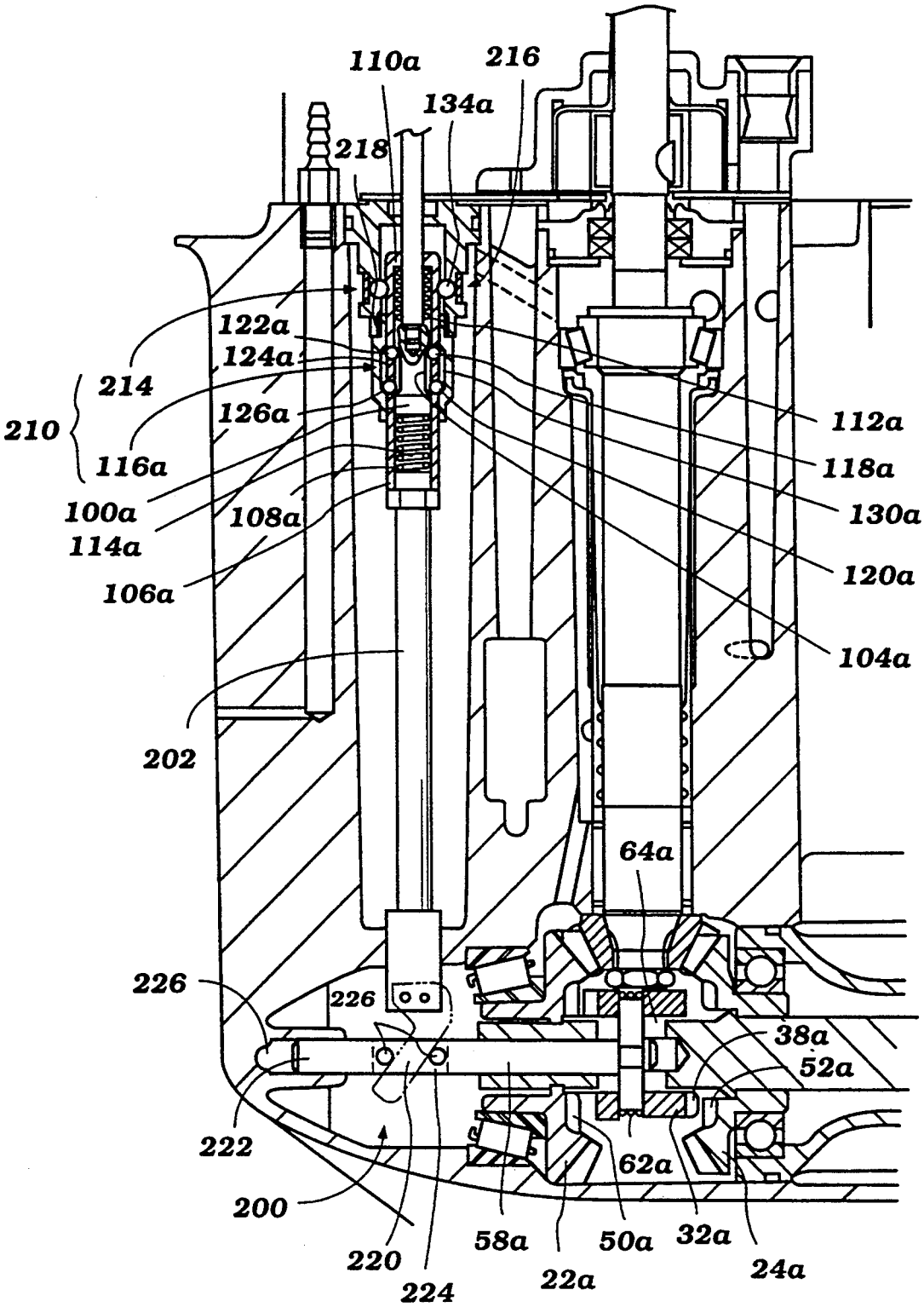
FIG. 3 is a sectional, elevational view of a marine outboard drive employing a shift assistor in accordance with another preferred embodiment of the present invention.

Embodiment of FIG. 3

FIG. 3 illustrates a shift assistor 70*a* which is configured in accordance with another preferred embodiment of the present invention. Where appropriate, like numerals with an "a" suffix have been used to indicate like parts of the two embodiments for ease of understanding. Similar to the above embodiment, the shift assistor 70*a* is positioned between a shift rod 56*a* and an actuator mechanism 200.

In this embodiment, the shift assistor 70*a* includes a cylindrical plunger 100*a* attached to the lower end of the shift rod 56*a*. The plunger 100*a* desirably includes a releasable snap connection with the shift rod 56*a* to facilitate removal of the lower unit 10*a*, as known in the art. The plunger 100*a* includes an annular recess 104*a* which circumscribes a midsection of the plunger 100*a*.

The shift assistor 70*a* also includes an intermediate tubular casing 106*a* having an inner bore 108*a* through which the plunger 100*a* slides. The intermediate casing 106*a* carries a detent coupling 116*a* which selectively couples the plunger 100*a* and the intermediate casing 106*a* together, as described below. In this embodiment, the detent coupling 116*a* desirable includes at least a first detent 118*a* and a second detent 120*a* positioned in corresponding transverse holes, and more preferably include a first pair of diametrically opposed detents 118*a* positioned in a first transverse hole 122*a*, and a second pair of diametrically opposed detents 120*a* positioned in a second transverse hole 124*a*. The transverse holes 122*a*, 124*a* are spaced apart axially along the intermediate casing 106*a*. The diameters of the detents 118*a*, 120*a* are slightly smaller than the diameter of the corresponding holes 120*a*, 124*a* so that the detents 118*a*, 120*a* pass freely through the holes 122*a*, 124*a*.

In the illustrated embodiment, the intermediate casing 106*a* includes a generally closed upper end 110*a* which defines an aperture through which the shift rod passes 56*a*. At its lower end, the intermediate casing 106*a* connects to an actuator shaft 202 which in turn connects to the actuator mechanism 200 described below. An upper end of the actuator shaft 202 is piloted into a lower end of the intermediate casing 106*a* and is attached thereto by known means, such as, for example, by a interference fit.

As FIG. 2*a* illustrates, the plunger 100*a* is captured within the intermediate casing 106*a*. The inner bore 108*a* of the casing 106*a* has a diameter slightly larger than that of the cylindrical plunger 100*a*. The plunger 100*a* thus freely slides within the bore 108*a*. The plunger 100*a*, however, is interposed between a pair of biasing members 112*a*, 114*a*, such as springs, which support the plunger 100*a* within the bore 108*a*.

An outer casing 126*a* of the shift assistor 70*a* supports the intermediate casing 106*a* and the detent coupling 116*a*. The outer casing 126*a* slidably supports the intermediate casing 106*a* within an inner bore 128*a*. The outer casing 126*a* also includes an annular recess 130*a* within its inner bore 128*a*.

The outer casing recess 130*a* and the plunger recess 104*a* desirably have substantially equal axial lengths which are also generally equal to the spacing between the upper and lower detents 118*a*, 120*a*. Each recess 104*a*, 130*a* desirably has an axial length greater than the distance by which the actuator shaft 202 moves from its neutral position to a position in which the clutch 32*a* engages a driven gear 22*a*, 24*a*. Each recess 104*a*, 130*a* also has a depth which is sized to receive the portion of the detents 118*a*, 120*a* which extend beyond the wall of the intermediate casing 106*a* when the other recess 104*a*, 130*a* is out of phase, i.e., when the recesses 104*a*, 130*a* do not coincide, as illustrated in FIGS. 2*a* and 2*b*. The recesses 104*a*, 130*a* also include cam surfaces 129*a*, 131*a* at their axial ends.

With reference to FIG. 3, a detent mechanism 210 desirably retains the actuator shaft 202 (and the coupled clutch 32*a*) in the neutral position. In the illustrated embodiment, the neutral detent mechanism 210 is formed with the shift assistor 70*a*.

The neutral detent mechanism 210 is formed in part by at least one transversely positioned hole 212 which intersects the inner bore 128*a* of the outer casing 126*a*. The transverse hole 212 receive detent balls 134*a*. The detent balls 134*a* have a diameter slightly smaller than diameter of the hole 212.

The intermediate casing 106*a* includes detent recesses 140*a* formed on its exterior bearing surface which slides within the inner bore 128*a* of the outer casing 126*a*. These recesses 140*a* are positioned so as to align the detent hole 212 of the outer casing 126*a* and the detent recesses 140*a* of the intermediate casing 106*a* when the clutch 32 (which is attached to the intermediate casing 106*a* via the actuator shaft 202 and the actuator mechanism 200) rests in the neutral position.

A biasing mechanism 214 urges the detent balls 134*a* radially inward, against the exterior surface of the intermediate casing 106*a*. In the illustrated embodiment, the biasing mechanism 214 includes a biasing member 216, such as, for example, a retention band 216, disposed within a retaining groove 218 that circumscribes the exterior of the outer casing 126*a*. It is contemplated, however, that the biasing member 216 could be compression springs, leaf springs or the like as well.

The biasing mechanism 214 forces portions of the detent balls 134*a* into the corresponding detent recesses 140*a* when the intermediate casing 106*a* is moved into the neutral position, as illustrated in FIG. 3. The spring force acting on the detent balls 134*a* biases the detent balls 134*a* into this position. This releasably connection between the detent balls 134*a* and the detent recesses 140*a* releasably restrains movement of the intermediate casing 106*a* relative to the outer casing 126*a*.

With reference to FIG. 3, the actuator mechanism 200 includes a cam member 220 attached to the lower end of the actuator shaft 202 and a follower member 222. The cam member 220 extends though an aperture 224 of the follower member 222 and rides between a pair of rollers or pins 226 that extend across the aperture 224. The rollers 226 and cam member 220 are arranged so as to convert vertical linear motion of the actuator shaft 202 into horizontal linear motion of the follower member 222. The cam member 220 forces the follower member 222 to slide axially as the actuator shaft 202 moves up and down. In the illustrated embodiment, upward movement of the cam member 220 causes the follower member 222 to move forward, and downward movement of the cam member 220 causes the follower member 222 to move rearward.

A recess 226 formed at the front end of the lower unit slidably supports the follower member 222. The front recess 226 has a sufficient length to permit the follower member 222 to reciprocate in the direction of the propulsion shaft 18*a*, as described below.

The follower member 222 connects to the plunger 58*a* to reciprocate the plunger 58*a* between the forward, neutral, reverse drive positions. The follower member 222 connects to the plunger 58*a* by any of a variety of know means which transmits linear motion to the plunger 58*a* while permitting the plunger 58*a* to rotate relative to the follower member 222.

The operation of this embodiment will now be described. A shift operator (not shown) actuates the shift rod 56*a* in a known manner to establish a forward drive condition. The shift rod 56*a* moves the plunger 100*a* downward. The plunger 100*a* compresses the lower biasing member 114*a* between the plunger's lower end and the upper end of the actuator shaft 202, which is piloted in the lower end of the intermediate casing 106*a*. The plunger 100*a* fully compresses (i.e., loads) the biasing member 114*a*. With the biasing member 114*a* fully loaded, further movement of the plunger 100*a* causes the actuator shaft 202 to move downward relative to the outer casing 126*a*. When the plunger 100*a* is moved with sufficient force to overcome the retaining force of the neutral detent mechanism 210, the detent balls 134*a* ride over the wall of the detent recesses 140*a* and are cammed inwardly against the action of the biasing mechanism 214.

The actuator shaft 202 begins to move downward under to force of the loaded spring 114*a* once the neutral detent mechanism 210 has released. The actuator shaft 202 and the attached intermediate casing 106*a* move together from a neutral position to a forward drive position. The downward movement of the actuator shaft 202 causes the follower member 222 of the actuator mechanism 200 to move rearward, which in turn moves the plunger 58*a* rearward. The clutch 32*a*, carried by plunger 58*a*, in turn moves rearward to engage the rear driven gear 24*a* of the transmission 14*a*. Importantly, the clutch 32*a* engages the driven gear 24*a* under the resilient force of the biasing member 114*a* of the shift assistor 70*a* in order to reduce coupling shock and to allow the corresponding teeth 38, 52 of the clutch 32 and gear 24 to register before engagement.

The detent coupling mechanism 116*a* couples the intermediate casing 106*a* and the plunger 100*a* together when in the forward drive position. Specifically, the lower detent 120*a* is captured partially within the annular recess 104*a* of the plunger 100*a* and partially within the transverse hole 122*a*, 124*a* of the intermediate casing 106*a*, as described above in connection with the first embodiment. The lower detents 120*a* contact the lower camming surface 131*a* of plunger recess 104*a* in this position.

The relative movement between the intermediate casing 106*a* and the outer casing 126*a* and the plunger 100*a* actuate the detent coupling mechanism 116*a*. Initially, the plunger recess 104*a* and the corresponding recess 130*a* of the outer casing 126*a* coincide when the plunger 100*a* and intermediate casing 106*a* are in their neutral positions. The detents 118*a*, 120*a* float freely between the recesses 104*a*, 130*a*. As the plunger 100*a* slides within the intermediate casing 106*a* to compress the lower spring 114*a*, an upper section of the plunger 100*a* forces the upper detents 118*a* outwardly, into the recess 130*a* of the outer casing 126*a*. The lower detents 120*a* still freely float between the corresponding recesses 104*a*, 130*a* when the plunger 100*a* has loaded the spring 114*a*. When the intermediate casing 106*a* moves from its neutral position to its forward drive position and relative to the plunger 100*a* and outer casing 106*a*, the lower cam surface 129*a* of the outer casing recess 130*a* forces the lower detents 118 into the plunger recess 104*a*. The intermediate casing 106*a* moves relative to the plunger 100*a* and outer casing 126*a* under the force of the spring 114*a* to a position where the lower detents 120*a* are captured within the plunger recess 104*a* and against the lower camming surface 131*a* of the plunger recess 104*a*. In this manner, the intermediate casing 106*a* and the plunger 100*a* are coupled to move together.

This direct coupling of the intermediate casing 106*a* and plunger 100*a* allows the clutch 32*a* to be disengaged under a positive force. The shift rod 56*a*, under the control of the shift operator (not shown) discussed above, moves the plunger 100*a* upward. The intermediate casing 106*a* also moves upward with the plunger 100*a* as the detent coupling 116*a* maintains their interconnection until these components return to their neutral position.

To establish a reverse drive condition, the shift rod 56*a* and plunger 100*a* are actuated in the upward direction. Again, the plunger 100*a* initially loads the biasing member 112*a* before the neutral detent mechanism 210 releases. The loaded biasing member 112*a* resilient urges the actuator shaft 202 upward once the neutral detent mechanism 210 has released. The actuator shaft 202 moves to a reverse position in which the clutch 32*a* engages the front driven gear 22*a* of the transmission 14*a* to establish a reverse drive condition.

In the reverse position, the detent coupling 116*a* again couples the intermediate casing 106*a* and the plunger 100*a* together. The upper detents 118*a* are captured partially within the annular recess 104*a* of the plunger 100*a* and partially within the corresponding transverse hole 122*a* of the intermediate casing 106*a*, as described above. The upper detents 118*a* contact the upper camming surface 129*a* of plunger recess 104*a* in this position. The relative movement between the intermediate casing 106*a* and the outer casing 126*a* and plunger 100*a* actuate the detent coupling 116*a* in a manner identical to that described in connection with the establishment of the forward drive condition.

This direct coupling of the intermediate casing 106*a* and plunger 100*a* again allows the clutch 32*a* to be disengaged under a positive force. The shift rod 56*a*, under the control of the shift operator, moves the plunger 100*a* downward. The intermediate casing 106*a* also moves downward with the plunger 100*a* as the detent coupling 116*a* maintains their interconnection until these components return to their neutral position.

Figure 4:
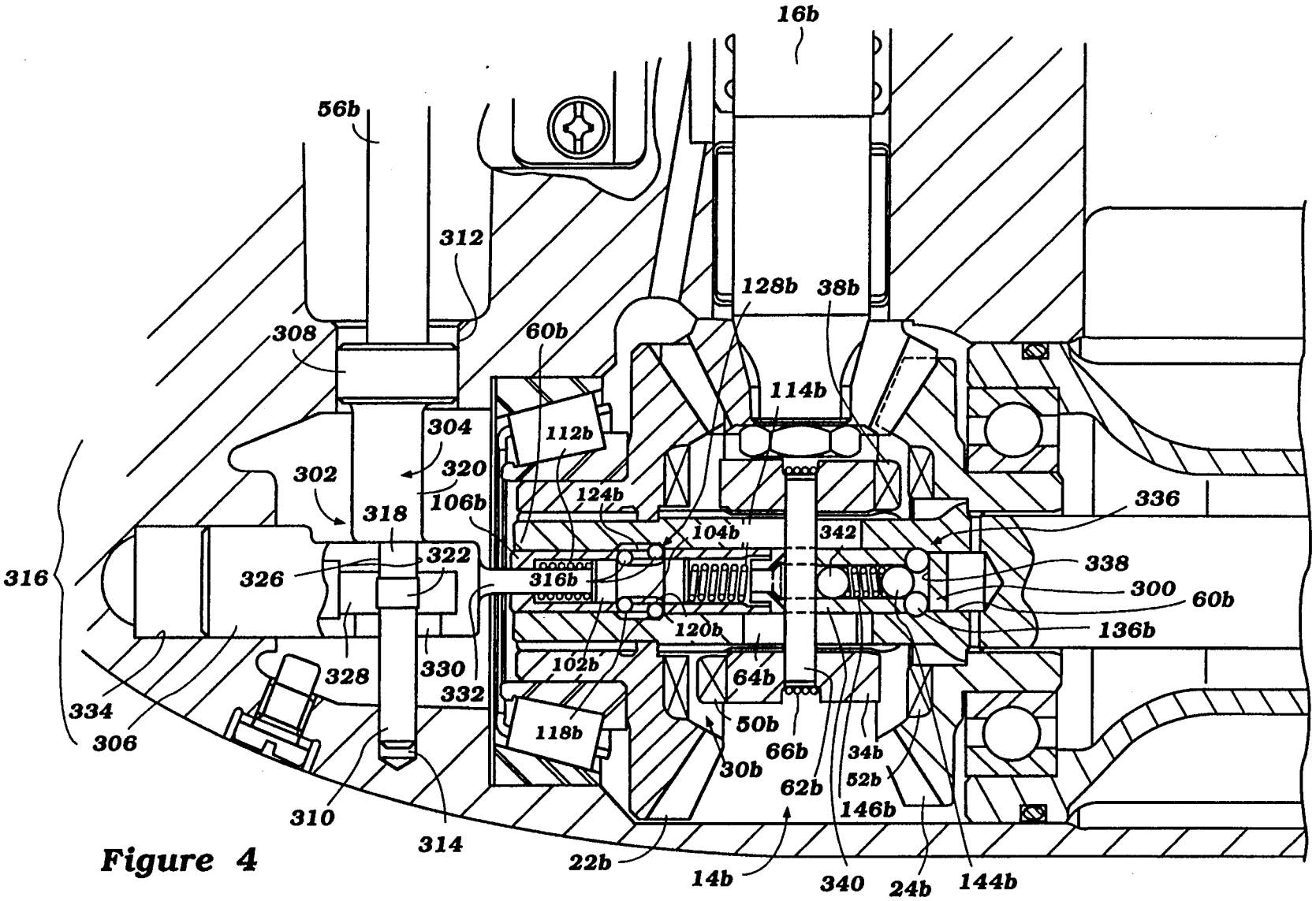
FIG. 4 is a sectional, elevational view of a marine outboard drive employing a shift assistor in accordance with an additional preferred embodiment of the present invention.

Embodiment of FIG. 4

FIG. 4 illustrates a shift assistor 70*b* in accordance with an additional preferred embodiment of the present invention. Where appropriate, like numerals with a "b" suffix have been used to indicate like parts of the embodiments for ease of understanding. In this embodiment, the shift assistor 70*b* is integrally formed with a clutch actuator 300 and the propulsion shaft 18*b*.

FIG. 4 also illustrates a cam and follower type of actuator mechanism 302 which may also be incorporated with the present invention, as an alternative to the actuator mechanisms described above. The actuator mechanism 302 includes a cam member 304 affixed to a lower end of the shift rod 56*a* and a follower member 306 connected to the plunger 100*b*, as described below. Rotational movement of the cam member 304 produces linear movement of the follower member 306.

The cam member 304 includes a cylindrical upper bearing 308 and a smaller diameter, cylindrical lower bearing 310. The cylindrical bearings 308, 310 are substantially aligned along the axis of the shift rod 56*a* and are suitable journaled with an upper bore 312 and a lower bore 314 of the lower unit 10*b*, respectively.

The cam member 304 includes a crank 316 positioned between the upper and lower cylindrical bearings 308, 310. The crank 316 is formed by an eccentrically positioned drive pin 318 interposed between an upper arm 320 and a lower arm 322. The drive pin 318 is eccentric relative to the axis of the shift rod 56*b*. The upper arm 320 connects to the upper cylindrical bearing 308 and the lower arm 322 connects to the lower bearing 310.

The follower member 306 has a generally cylindrical shape. An engagement recess 324 is formed within the follower member 306 and defines a pair of opposing, generally vertical surfaces 326. The engagement recess 324 is sized to receive a portion of the drive pin 318 of the cam member 304 which is positioned between the opposing surfaces 326 of the follower member 306.

The follower member 306 also includes a clearance recess 328 which is positioned below the engagement recess 324. The clearance recess 328 has a sufficient size to permit the lower arm 322 of the crank 316 to pivot about the lower bearing 310.

For a similar purpose, the follower member additionally includes a lower elongated slot 330 positioned below the clearance recess 328. The slot 330 has a sufficient width to receive the lower cylindrical bearing 310 and a sufficient length so as to permit reciprocation of the follower member 306, as discussed below. The follower member 306 also includes an arm 332 which connects to a plunger 100*b* of the shift assistor 70*b*, described below.

The follower member 306 is slidably supported in a recess 334 formed at the front end of the lower unit 10*b*. The front recess 334 has a sufficient length in the longitudinal direction to permit the follower member 306 to reciprocate in the longitudinal direction, as described below.

With reference to FIG. 4, the plunger 100*b* of the shift assistor 70*b* generally has a cylindrical shape and desirably is integrally formed with the follower member 306 of the actuator mechanism 302. The plunger 100*b* includes an annular recess 104*b* which circumscribes a midsection of the plunger 100*b*.

The shift assistor 70*b* also includes an intermediate casing 106*b* having an inner bore 108*b* through which the plunger 100*b* slides. The intermediate casing 106*b* carries a detent coupling 116*b* which selectively couples the plunger 100*b* and the intermediate casing 106*b* together. The detent coupling 116*b* is essentially identical to those described above in connection with the other embodiments, and the above description of the detent coupling will be understood as applying equally to the present embodiment unless specified to the contrary.

The intermediate casing 106*b* includes a generally closed front end that forms an aperture through which the arm 332 of the follower member 306 passes. At its lower end, the intermediate casing 106*b* connects to the clutch actuator 300. The clutch actuator 300 has a threaded or like connection to secure the clutch actuator 300 to the intermediate casing 106*b*.

A pair of biasing member 112*b*,,114*b*, such as, for example, compression springs, are disposed on either side of the plunger 100*b* which is captured within the intermediate casing 106*b*.

The propulsion shaft 18*b* includes an inner bore 60*b* at its forward end which slidably supports the intermediate casing 106*b* and the clutch actuator 300. The propulsion shaft 18*b* also includes an annular recess 130*b* within its inner bore 60*b*.

The clutch actuator 300 carries a pin 62*b* which couples the clutch 32*b* to the clutch actuator 300 in a manner similar to that described above in connection with the plunger 58 (FIG. 1) of the above embodiment. The clutch actuator 300 also carries a detent mechanism 336 which retains the clutch 32*b* in a desired drive condition. In the embodiment illustrated in FIG. 4, the detent mechanism 336 retains the clutch 32*b* in a neutral position.

The neutral detent mechanism 336 is formed in part by a transversely position hole 338 in the clutch actuator 300 which intersects an axial bore 340 of the clutch actuator 300. The transverse hole 338 receives at least one and desirably two detent balls 134*b*. The detent balls 134*b* have a diameter slightly smaller than the diameter of the hole 338.

The propulsion shaft 18*b* includes detent recesses 140*b* formed on the inner wall of the inner bore 60*b* through which the clutch actuator 300 slides. The recesses 140*b* are positioned so as to locate the clutch 32*b* in the neutral position when the detent hole 338 of the clutch actuator 300 is aligned with the detent recesses 140*b* of the propulsion shaft 18*b*.

A ball plunger 142, formed by a pair of larger balls 342, 144*b* and an interposed helical compression spring 146*b*, biases the detent balls 134*b* radially outwardly, against the inner wall of the propulsion shaft 18*b*. The larger balls 342, 144*b* have diameters which permit the balls 342, 144*b* to slide within the axial bore 340 of the clutch actuator 300. The forward ball 342 contacts the pin 62*b* which passes through the clutch actuator 300 to simplify construction of the detent mechanism 336, as known in the art.

The spring 146*b*, fixed at its forward end against the large front ball 342, biases the larger rear ball 144*b* rearward. The larger rear ball 146*b* consequentially forces portions of the detent balls 134*b* into the corresponding detent recesses 140*b* when the clutch actuator 300 is moved into the neutral position, as illustrated in FIG. 4. The continuing spring force on the large rear ball 146*b* urges the detent balls 134*b* into this position. This releasable connection between the detent balls 136*b* and the detent recesses 140*b* releasably restrains movement of the clutch actuator 300 relative to the propulsion shaft 18*b*.

The operation of this embodiment will now be described. In the illustrated embodiment of FIG. 4, to engage the drive shaft 16*b* with the propulsion shaft 18*b* for a forward drive condition, the gear shift lever (not shown) is moved from a neutral position to a forward position. The shift rod 56*b* rotates in response which causes the crank 316 attached to its lower end to rotate in the forward direction. Forward rotation of the cam member 304 moves the follower member 306 forward.

The follower member 306 consequentially pulls the plunger 100*b* forward. The plunger 100*b* moves forward and loads the forward biasing member 112b. In the illustrated embodiment, the plunger 100b compresses the forward spring 112b between its forward end and the forward end of the intermediate casing 106b. Further movement of the plunger 100b causes the intermediate casing 106b and clutch actuator 300 to move forward relative to the propulsion shaft 18b. When the follower member 306 pulls the plunger 100b with sufficient force to overcome the retaining force of the neutral detent mechanism 336, the detent balls 134b ride over the wall of the detent recesses 140b and are cammed inwardly against the action of the ball plunger 142b.

The intermediate casing 106b and clutch actuator 300 begins to move forward under the force of the loaded biasing member 112b once the neutral detent mechanism 336 has released. The clutch actuator 300 moves from the neutral position to a forward position in which the clutch 32b engages the forward driven gear 22b. Importantly, as noted in connection with the above-described embodiments, the clutch 32b engages the driven gear 226 under the resilient force of the biasing member 112b in order to reduce coupling shock and to allow the corresponding teeth 38b, 52b of the clutch 32b and gear 226 to register before engagement. The intermediate casing 106b rotates with the propulsion shaft 18b about plunger 100b when a forward drive condition has been established. The clutch actuator 300 also rotates with the intermediate casing 106b.

The detent coupling mechanism 116b couples the intermediate casing 106b and the plunger 100b together when in the forward drive position. Specifically, the forward detents 118b are captured partially within the annular recess 104b of the plunger 100b and partially within the transverse hole 122b of the intermediate casing 106b, as described above in connection with the other embodiments. The forward detents 118b contact the forward camming surface 129b of plunger recess 104b in this position. The relative axial movement between the intermediate casing 106b and the propulsion shaft 18b and plunger 100b actuate the detent coupling 116b in a manner identical to that described above in connection with the other embodiments.

This direct coupling of the intermediate casing 106b and plunger 100b allows the clutch 32b to be disengaged under a positive force. The follower member 306, under the control of the shift operator, moves the plunger 100b rearward. The intermediate casing 106b also moves rearward with the plunger 100b as the detent coupling 116b maintains their interconnection until these components return to their neutral position.

To establish a reverse drive condition, the follower member 306 and plunger 100b are actuated in the rearward direction. Again, the plunger 100b initially loads the biasing member 114b before the neutral detent mechanism 336 releases. The loaded biasing member 114b resilient urges the clutch actuator 300 rearward once the neutral detent mechanism 336 has released. The clutch actuator 300 moves to a rear position in which the coupled clutch 32b engages the rear driven gear 24b of the transmission 14b to establish a reverse drive condition.

In the reverse position, the detent coupling 116b again couples the intermediate casing 106b and the plunger 100b together. The rear detents 120b are captured partially within the annular recess 104b of the plunger 100b and partially within the corresponding transverse hole 124b of the intermediate casing 106b, as described above. The rear detents 106b contact the rear camming surface 129b of plunger recess 104b in this position.

This direct coupling of the intermediate casing 106b and plunger 100b allows the clutch 32b to be disengaged under a positive force. The follower member 306, under the control of the shift operator, moves the plunger 100b forward. The intermediate casing 106b also moves forward with the plunger 100b as the detent coupling 116b maintains their interconnection until these components return to their neutral position.

The foregoing embodiments illustrate several ways in which the present invention may be adopted to be used with a variety of shifting mechanisms of outboard drives. In each embodiment, the shift assistor establishes engagement of the transmission under a resilient force and disengagement under a positive force. Additionally, in each embodiment, the shift assistor involves a simply structured device in which a single coupling mechanism, directly operable between a shift operator and a transmission actuator, selectively couples these components together when the transmission is engaged.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A shift assistor for a shifting mechanism of a watercraft outboard drive which selectively establishes at least a first, second and third drive condition of a transmission, said shift assistor comprising a first member and a second member, said first member being coupled to said transmission and being movable from a first position, in which the transmission is in the first drive condition, to either a second position, in which the transmission is in the second drive condition, or a third position in which the transmission is in the third drive condition, and said second member being movable from a first position to either a second position or a third position, said second member being interposed between a pair of biasing members which are contained within said first member, a detent coupling directly operable between said first member and said second member to releasably couple said first and second members together, and a detent mechanism being releasably coupled to said first member to releasably retain said first member in one of said positions, said second member being movable from said first position to either said second or third positions to load one of said biasing members and to urge said first member to release from said detent mechanism, one of said biasing members urging said first member from its first position to either its second or third positions in which said detent coupling couples said first and second members together.

2. The shift assistor of claim 1, wherein said detent coupling couples said first and second members together as said first and second members move from either said second or third positions to said first position, and decouples said first and second members in said first position so that said first and second members are movable relative to each other from said first position to either said second or third positions.

3. The shift assistor of claim 1, wherein said first member is connected to a transmission actuator and said second member is connected to a shift operator.

4. The shift assistor of claim 1, wherein said detent coupling comprises a plurality of detents carried by said first member which are axially spaced apart from each other, and a recess which is formed in said second member and arranged to receive said detents, said detents reciprocating into and out of said recess to releasably couple said first and second members together.

5. A shifting mechanism for an outboard drive of a watercraft which selectively establishes either a first drive condition or a second drive condition of a transmission, said shifting mechanism comprising a shift operator and a transmission actuator selectively coupled together by a shift assistor in a releasably manner when said transmission actuator is in a first position with the transmission in the first drive condition, and when said transmission actuator is in a second position with the transmission in the second drive condition, said shift assistor comprising juxtaposed first and second members which are supported for relative movement such that said first and second members slide in contact with each other when said transmission actuator is moved between said first and second positions, said first member connected to said shift operator and said second member connected to said transmission actuator, and a detent coupling which is directly operable between said first and second members to releasably couple said first and second members together when said transmission actuator is in said first position and in said second position.

6. The shifting mechanism of claim 5, wherein said first and second members are movable from said first and second positions to a third position in which the transmission is in a third drive condition, said detent coupling coupling said first and second members together as said first and second members move from said first position to said third position and from said second position to said third position, and decoupling said first and second members when in said third position to allow said first and second members to move relative to each other from said third position to either said first or second positions.

7. The shifting mechanism of claim 5 additionally comprising a biasing member interposed between said first and second members and a detent retaining mechanism coupled to said second member to releasably retain said second member in a third position in which the transmission is in a third drive condition.

8. The shifting mechanism of claim 7, wherein said first member is movable from the third position to either said first or second positions to load said biasing member and to positively force said second member to release from said detent retaining mechanism.

9. The shifting mechanism of claim 8, wherein said biasing member urges said second member to either said first or second positions from said third position with said second member released from said detent retaining member and said biasing member loaded by said first member.

10. The shifting mechanism of claim 5, wherein said shift assistor is positioned within a propulsion shaft which is selectively coupled to the transmission.

11. The shifting mechanism of claim 5, wherein said detent coupling comprises a plurality of detents which are axially spaced apart and which reciprocate into and out of a recess.

12. The shifting mechanism of claim 11, wherein said second member carries said detents and said first member carries said recess.

13. A shifting mechanism for an outboard drive of a watercraft which establishes at least a first, second and third drive condition of a transmission, said shifting mechanism comprising a shift operator and transmission actuator interconnected by a shift assistor to move said transmission actuator between at least a first position, in which the transmission is in the first drive condition, a second position, in which the transmission is in the second drive condition, and a third position, in which the transmission is in the third drive condition, said shift assistor comprising a first member connected to said shift operator, a second member connected to said transmission actuator, said first and second members juxtaposed to each other and supported for relative movement, and a detent coupling directly operable between said first and second members to releasably couple said first and second members together in said second and third positions, said detent coupling comprising first and second detents being carried by said second member and being axially spaced apart, and a corresponding first recess carried by said first member and arranged to selectively receive said detents to couple said first and second members together in said second and third positions.

14. The shifting mechanism of claim 13 additionally comprising a detent mechanism releasably coupled to said transmission actuator to releasably restrain said transmission actuator in one of said first, second or third positions.

15. The shifting mechanism of claim 14, wherein said shift assistor additionally comprises a first biasing member interposed between said first member and one end of said second member, and a second biasing member interposed between said first member and an opposite end of said second member, said first member being movable from said first position to either said second position or said third position to load either said first biasing member or said second biasing member.

16. The shifting mechanism of claim 15, wherein said first and second members of said shift assistor are arranged such that said first member positively forces said second member to release from said detent mechanism with either said first or second biasing members being loaded.

17. The shifting mechanism of claim 16, wherein either said first or second biasing members urges said second member to move to either said the second or third positions.

18. The shifting mechanism of claim 17, wherein said shift assistor additionally comprises a third member juxtaposed to said second member, said second and third members being supported for relative movement, said third member having a second recess which generally opposes said first recess of said first member, said first and second recess being arranged such that said detents reciprocate between said first and second recesses to interconnect and disconnect said first and second members.

19. The shifting mechanism of claim 18, wherein said first member has a cylindrical shape with a neck portion of reduced diameter which forms said first recess, said second member has a tubular shape through which said first member slides, and said third member is a casing having an inner bore in which said second member slides, said third member including an annular relief within said inner bore which forms said second recess.

20. The shifting mechanism of claim 19, wherein said neck portion of said first member comprises cam surfaces at its axial ends, and said annular relief of said third member includes cam surfaces at its axial ends.

21. The shifting mechanism of claim 19, wherein said shift assistor additionally comprises a third detent and a fourth detent carried by said second member, said third detent being positioned diametrically opposite of said first detent and said fourth detent being positioned diametrically opposite of said second detent, said third and forth detents reciprocating between said neck portion of said first member and said annular relief of said third member so as to interconnect and disconnect said first and second members.

22. The shifting mechanism of claim 18, wherein said first recess of said first member has a length substantially equal to the distance between said detents.

23. The shifting member of claim 18, wherein said second recess of said third member has a length substantially equal to the distance between said detents.

24. The shifting member of claim 18, wherein said second recess of said third member has a length longer than a distance by which said shift assistor moves said transmission actuator from said first position to either said second or third positions.

* * * * *